US006598439B1

(12) United States Patent
Chen

(10) Patent No.: US 6,598,439 B1
(45) Date of Patent: Jul. 29, 2003

(54) LOCK-AND-ALARM ASSEMBLY

(75) Inventor: Fang-Kun Chen, Chia-Yi (TW)

(73) Assignee: EZ Trend Technology Co., Ltd., Chia-Yi (TW)

( * ) Notice: Subject to any disclaimer, the term of this patent is extended or adjusted under 35 U.S.C. 154(b) by 0 days.

(21) Appl. No.: 10/270,451

(22) Filed: Oct. 15, 2002

(51) Int. Cl.[7] ..... E05B 13/02; E05B 17/14

(52) U.S. Cl. ..... 70/423; 70/455; 70/416; 70/DIG. 49

(58) Field of Search ..... 70/423, 441, 455, 70/416, 158, DIG. 59, 427, 424, 428, 419, DIG. 49

(56) References Cited

U.S. PATENT DOCUMENTS 3,477,261 A * 11/1969 Siana ..... 70/427
3,797,004 A * 3/1974 Muessel et al. ..... 340/529
4,070,882 A * 1/1978 Ruiz ..... 70/427
4,726,206 A * 2/1988 Hsu ..... 70/441
5,195,342 A * 3/1993 Werner ..... 70/417
5,598,725 A * 2/1997 Chang ..... 70/209
5,927,112 A * 7/1999 Yamashita ..... 70/252

* cited by examiner

*Primary Examiner*—Anthony Knight
*Assistant Examiner*—John B. Walsh
(74) *Attorney, Agent, or Firm*—Baker Botts L.L.P.

(57) ABSTRACT

A lock-and-alarm assembly includes an escutcheon formed with a through-hole. A lock core is formed with a keyway that can be accessed through the through-hole. A blind is detachably mounted in the through-hole for blocking access to the keyway through the through-hole. A switch is connected to the blind and is actuated upon removal of the blind, which, in turn, results in actuation of an alarm.

3 Claims, 6 Drawing Sheets

LOCK-AND-ALARM ASSEMBLY

BACKGROUND OF THE INVENTION

1. Field of the Invention

This invention relates to a lock assembly, more particularly to a lock-and-alarm assembly.

2. Description of the Related Art

Conventionally, an electronic lock, which is operated using an electrically operated mechanism, such as a digital programmable microprocessor and a solenoid, for locking a door of a building or a car normally incorporates a manually operated mechanism, such as a key-operated mechanism, so as to permit manual unlocking of the electronic lock in case of breakdown of the electrically operated mechanism. However, the incorporation of the key-operated mechanism can lower the security of the electronic lock.

SUMMARY OF THE INVENTION

The object of the present invention is to provide a lock-and-alarm assembly to overcome the aforesaid drawback of the prior art.

According to the present invention, a lock-and-alarm assembly comprises: an escutcheon including a peripheral wall that confines a lock-mounting space and that has a front wall, the front wall confining a front side of the lock-mounting space and being formed with a through-hole that is confined by a hole-confining wall and that extends in a longitudinal direction; a lock core mounted in the lock-mounting space and formed with a keyway that is aligned with the through-hole; an engaging member; a blind mounted movably in the through-hole and movable between an engaging position, in which, the blind engages the hole-confining wall through the engaging member, thereby blocking the through-hole and preventing access to the keyway through the through-hole, and a disengaging position, in which the blind disengages from the hole-confining wall, thereby permitting removal of the blind from the through-hole and access to the keyway through the through-hole, the blind having a front wall formed with at least a channel that extends in the longitudinal direction and that is adapted to receive a tool therein in such a manner that operation of the tool results in movement of the blind from the engaging position to the disengaging position; an alarm; a switch electrically connected to the alarm and including a button mounted movably within the through-hole and disposed rearwardly of the channel, the button being operable to move rearwardly in the longitudinal direction for actuating the alarm; and an actuator disposed frontwardly of the button within the through-hole and including at least an insert that extends frontwardly therefrom into the channel in such a manner that the button is moved rearwardly to actuate the alarm upon insertion of the tool into the channel.

BRIEF DESCRIPTION OF THE DRAWINGS

In drawings which illustrate an embodiment of the invention.

DETAILED DESCRIPTION OF THE PREFERRED EMBODIMENT

Figure 1:
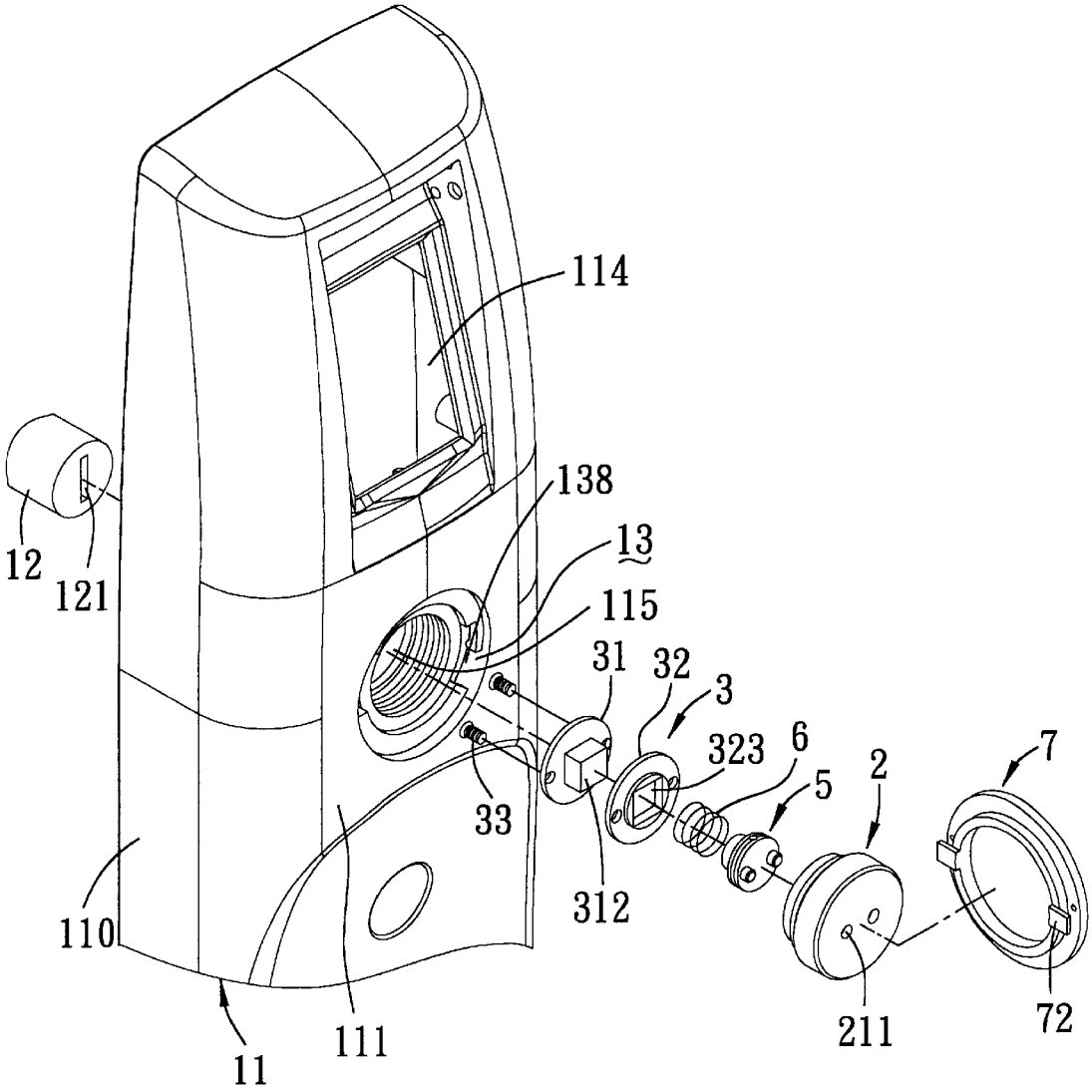
FIG. 1 is a fragmentary exploded perspective view of a lock-and-alarm assembly embodying this invention.
Figure 2:
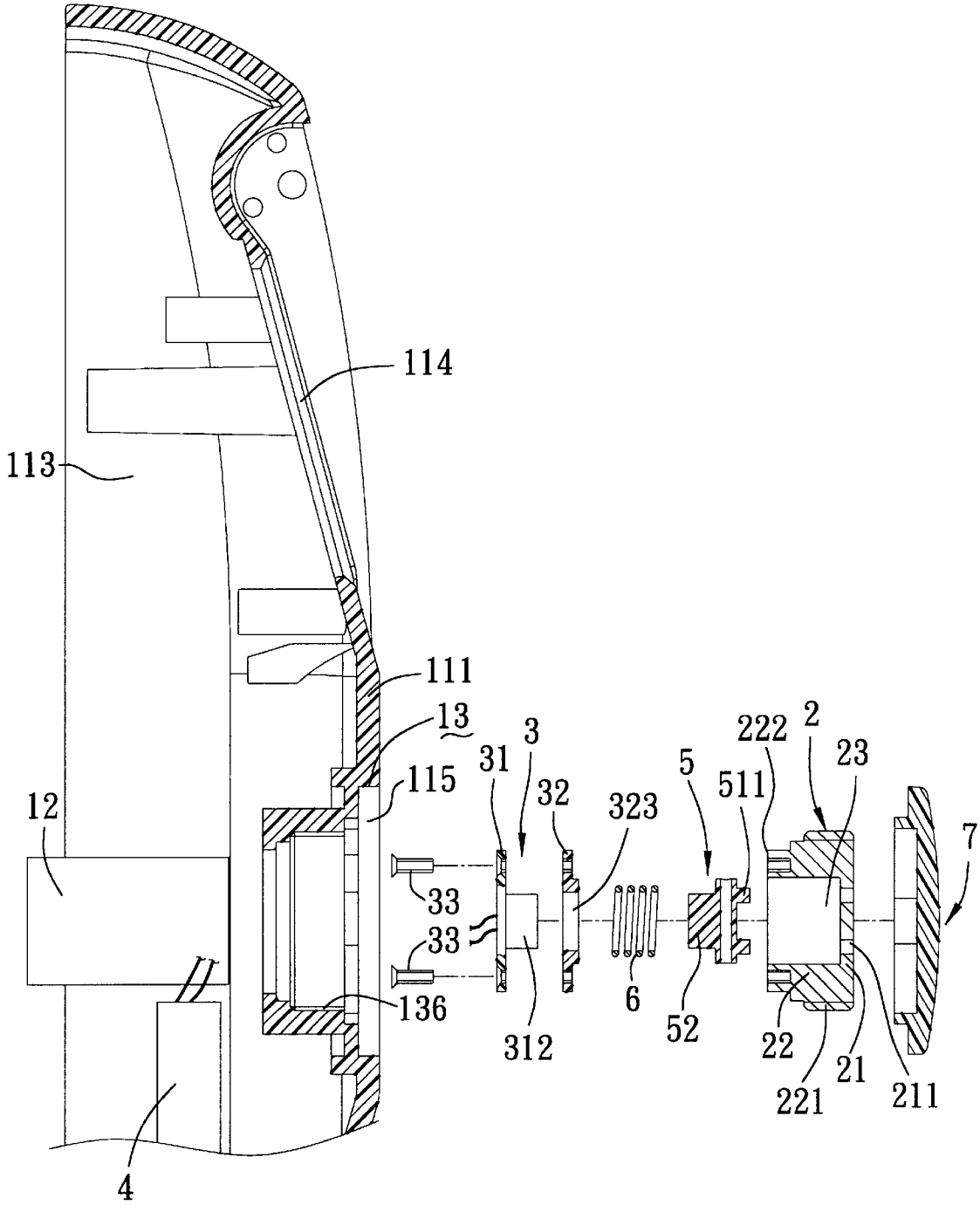
FIG. 2 is a fragmentary exploded sectional view of the lock-and-alarm assembly of FIG. 1.
Figure 3:
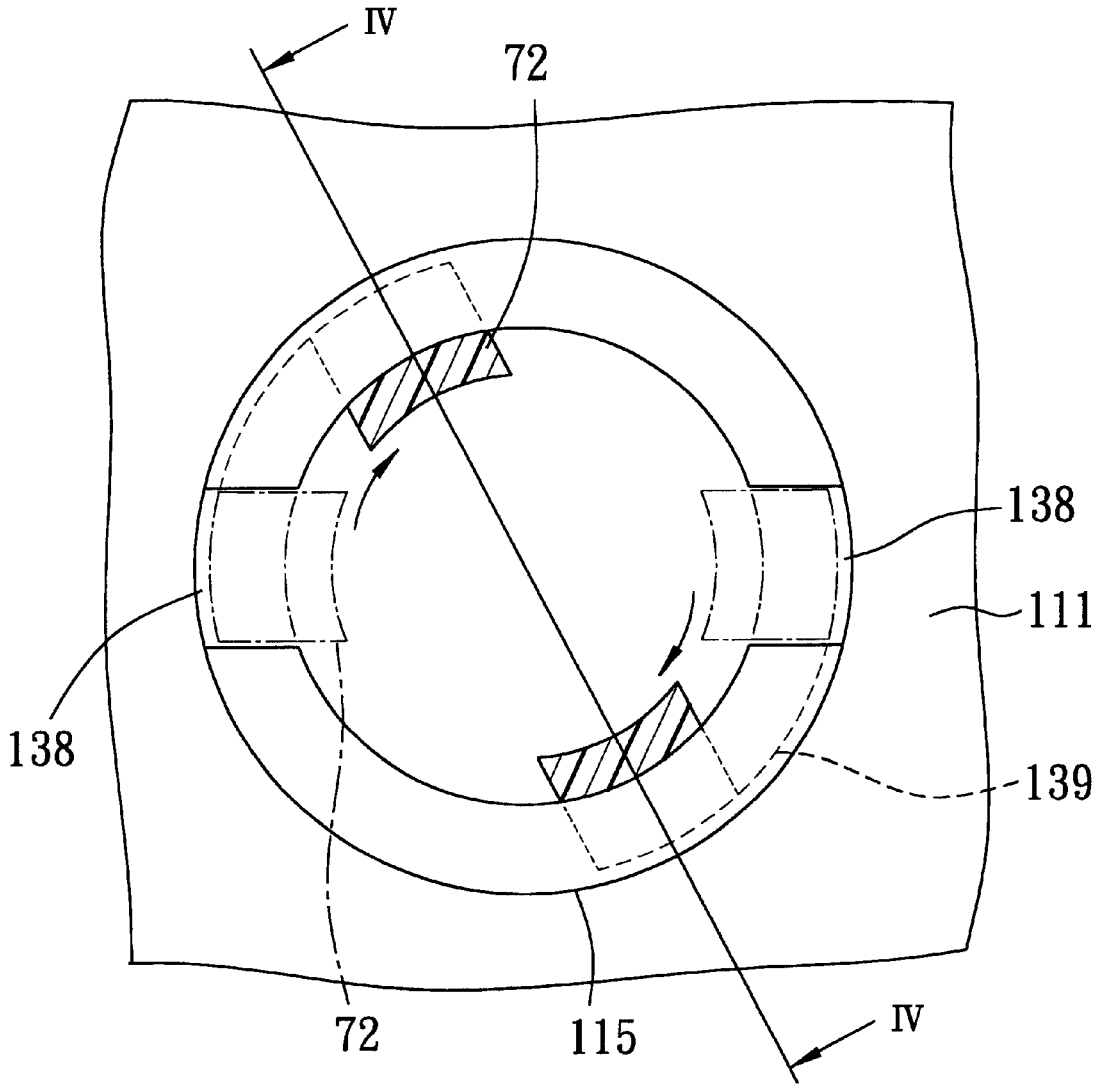
FIG. 3 is a fragmentary sectional view illustrating how a cover is attached to and detached from an escutcheon of the lock-and-alarm assembly of FIG. 1.
Figure 4:
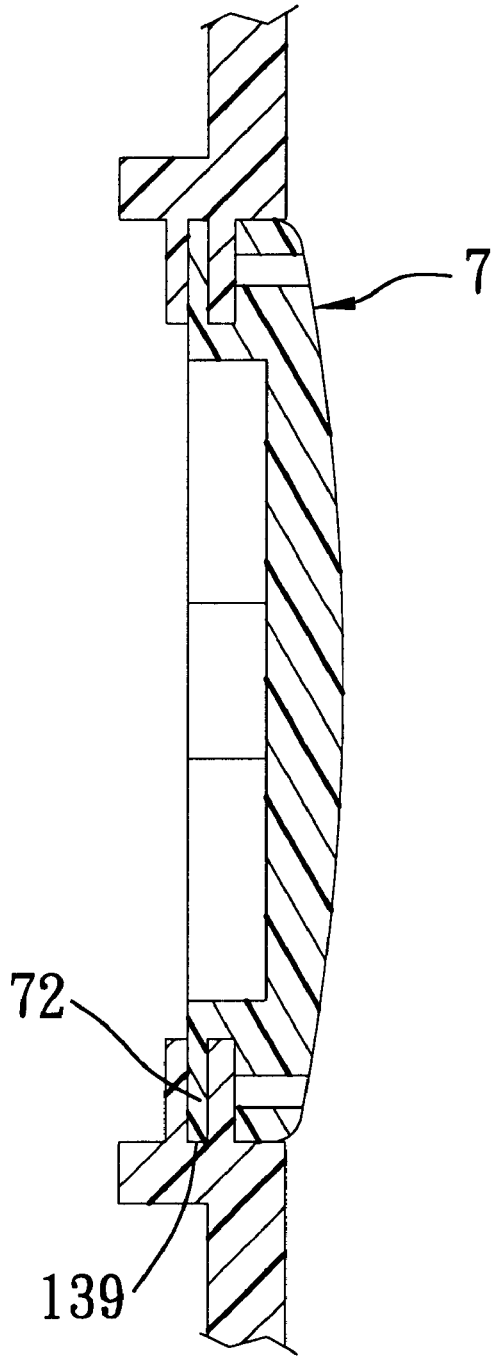
FIG. 4 is a sectional view taken along line IV—IV in FIG. 3.
Figure 5:
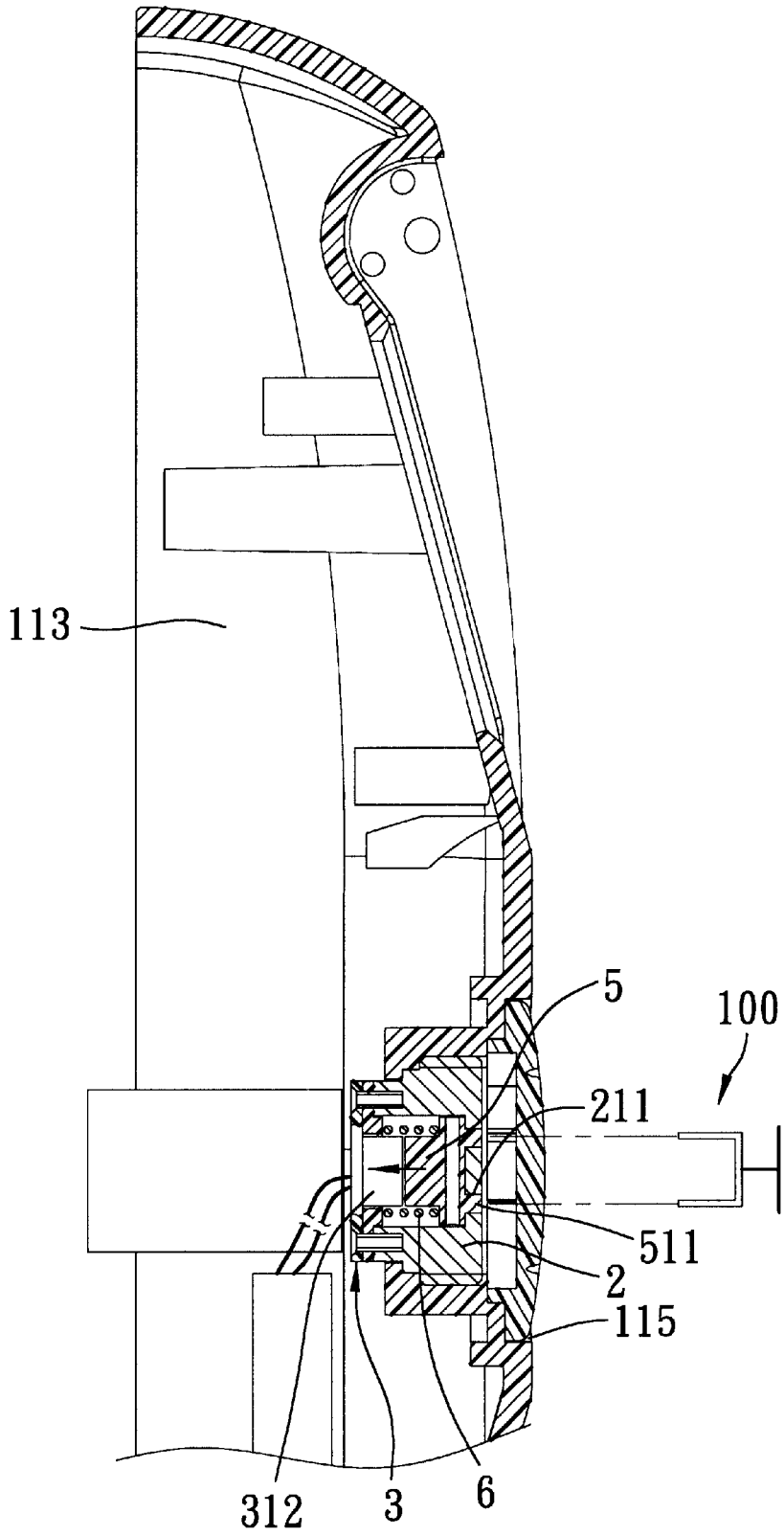
FIGS. 5 and 6 are fragmentary sectional views to illustrate how a blind of the lock-and-alarm assembly of FIG. 1 is disengaged from the escutcheon to expose a keyway in a key core.
Figure 6:
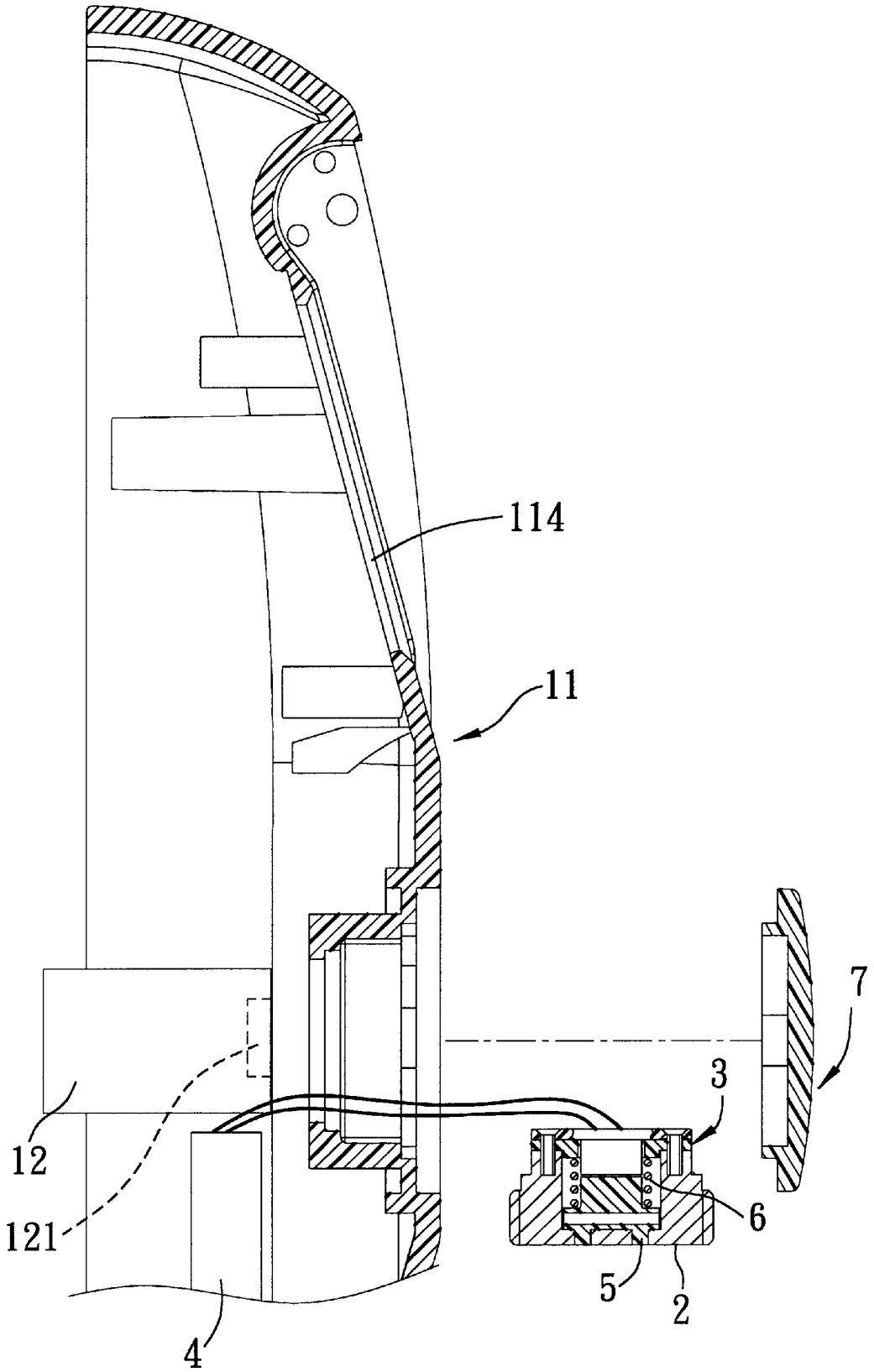

FIGS. 1 to 6 illustrate a preferred embodiment of a lock-and-alarm assembly of this invention that is adapted to be mounted on a door panel (not shown)

The lock-and-alarm assembly includes: an escutcheon 11 including a peripheral wall 110 that confines a lock-mounting space 113 and that has a front wall 111, the front wall 111 confining a front side of the lock-mounting space 113 and being formed with a through-hole 115 that is confined by a hole-confining wall 13 and that extends in a longitudinal direction; a lock core 12 mounted in the lock-mounting space 113 and formed with a keyway 121 that is aligned with the through-hole 115; an engaging member (136, 221); a blind 2 mounted movably in the through-hole 115 and movable between an engaging position (see FIG. 5), in which, the blind 2 engages the hole-confining wall 13 through the engaging member (136, 221), thereby blocking the through-hole 115 and preventing access to the keyway 121 through the through-hole 115, and a disengaging position (see FIG. 6), in which the blind 2 disengages from the hole-confining wall 13, thereby permitting removal of the blind 2 from the through-hole 115 and access to the keyway 121 through the through-hole 115, the blind 2 having a front wall 21 formed with at least a channel 211 (two opposing channels 211 are formed in the front wall 21 in this embodiment) that extends in the longitudinal direction and that is adapted to receive a tool 100 therein in such a manner that operation of the tool 100 results in movement of the blind 2 from the engaging position to the disengaging position; an alarm 4 mounted in the lock-receiving space 113; a switch 3 electrically connected to the alarm 4 and including a button 312 mounted movably within the through-hole 115 and disposed rearwardly of the channel 221, the button 312 being operable to move rearwardly in the longitudinal direction for actuating the alarm 4; and an actuator 5 disposed frontwardly of the button 312 within the through-hole 115 and including, at least an insert 511 (two opposing inserts 511 are formed on the actuator 5 in this embodiment) that extends frontwardly therefrom into the channel 211 in such a manner that the button 312 is moved rearwardly to actuate the alarm 4 upon insertion of the tool 100 into the channel 211. A known electrically operated mechanism (not shown) is mounted in the lock-receiving space 113 for performing locking and unlocking of the lock core 12. The electrically operated mechanism can include a sensor (not shown) mounted in a window 114 in the front wall 111 of the escutcheon 11 such that the lock core 12 can be unlocked by means of the sensor.

The engaging member (136, 221) includes an inner thread 136 that is formed on the hole-confining wall 13, and an outer thread 221 that is formed on the blind 2 and that threadedly engages the inner thread 136 when the blind 2 is received in the through-hole 115. The blind 2 is rotatable relative to the hole-confining wall 13 from the engaging position to the disengaging position when the tool 100 is inserted into the channel 211 and is rotated.

The blind 2 further has an annular flange 22 projecting rearwardly from the front wall 21 of the blind 2, having a rear end 222 opposite to the front wall 21 of the blind 2, and confining an actuator-receiving space 23. The outer thread 221 extends from a peripheral edge of the front wall 21 of the blind 2 to the annular flange 22 of the blind 2. The switch 3 further includes a frame plate 31 that is secured to the rear end 222 of the annular flange 22 through screw means 33 extending through the frame plate 31 and into the rear end 222 of the annular flange 22. The button 312 is mounted movably on the frame plate 31, and projects therefrom into the actuator-receiving space 23. The actuator 5 is received in the actuator-receiving space 23, and further includes a stud 52 projecting rearwardly therefrom to contact the button 312 so as to permit actuation of the alarm 4 upon insertion of the tool 100 into the channel 211. The actuator 5 further includes a coil spring 6 that is sleeved around the stud 52 for urging the actuator 5 to move frontwardly and for retaining the insert 511 in the channel 211. A spring-abutting plate 32 is disposed between the frame plate 31 and the stud 52, is formed with a central hole 323 for extension of the button 312 therethrough, and abuts against the coil spring 6 so as to permit the urging action of the coil spring 6 against the actuator 5.

The hole-confining wall 13 of the through-hole 115 in the front wall 111 of the escutcheon 11 is formed with a pair of opposing arcuate retaining grooves 139 that are disposed frontwardly of the inner thread 136. A cover 7 is formed with a pair of retaining tongues 72 that respectively extend into the retaining grooves 139 for covering the through-hole 115. The cover 7 can be removed from the front wall 111 of the escutcheon 11 by rotating to a position, in which the retaining tongues 72 are moved to respective gaps 138 between the retaining grooves 139.

In case of breakdown of the electrically operated mechanism, the lock core 12 can be unlocked by insertion of a key (not shown) into the keyway 121 in the lock core 12 upon removal of the blind 2 from the through-hole 115. The alarm 4 can be remotely controlled so as to be disabled by the user prior to removal of the blind 2 from the through-hole 115 in case of the breakdown of the electrically operated mechanism. Since the alarm 4 is actuated upon insertion of the tool 100 into the channel 211, theft can be prevented when the alarm 4 is in an enabled state.

With the invention thus explained, it is apparent that various modifications and variations can be made without departing from the spirit of the present invention. It is therefore intended that the invention be limited only as recited in the appended claims.

I claim:

1. A lock-and-alarm assembly comprising:

an escutcheon including a peripheral wall that confines a lock-mounting space and that has a front wall, said front wall confining a front side of said lock-mounting space and being formed with a through-hole that is confined by a hole-confining wall and that extends in a longitudinal direction;

a lock core mounted in said lock-mounting space and formed with a keyway that is aligned with said through-hole;

an engaging member;

a blind mounted movably in said through-hole and movable between an engaging position, in which, said blind engages said hole-confining wall through said engaging member, thereby blocking said through-hole and preventing access to said keyway through said through-hole, and a disengaging position, in which said blind disengages from said hole-confining wall, thereby permitting removal of said blind from said through-hole and access to said keyway through said through-hole, said blind having a front wall formed with at least a channel that extends in said longitudinal direction and that is adapted to receive a tool therein in such a manner that operation of the tool results in movement of said blind from said engaging position to said disengaging position;

an alarm;

a switch electrically connected to said alarm and including a button mounted movably within said through-hole and disposed rearwardly of said channel, said button being operable to move rearwardly in said longitudinal direction for actuating said alarm; and an actuator disposed frontwardly of said button within said through-hole and including at least an insert that extends frontwardly therefrom into said channel in such a manner that said button is moved rearwardly to actuate said alarm upon insertion of the tool into said channel.

2. The lock-and-alarm assembly of claim 1, wherein said engaging member includes an inner thread that is formed on said hole-confining wall, and an outer thread that is formed on said blind and that threadedly engages said inner thread when said blind is received in said through-hole, said blind being rotatable relative to said hole-confining wall from said engaging position to said disengaging position when the tool is inserted into said channel and is rotated.

3. The lock-and-alarm assembly of claim 2, wherein said blind further has an annular flange projecting rearwardly from said front wall of said blind, having a rear end opposite to said front wall of said blind, and confining an actuator-receiving space, said switch further including a frame plate that is secured to said rear end of said annular flange, said button being mounted movably on said frame plate and projecting therefrom into said actuator-receiving space, said actuator being received in said actuator-receiving space and further including a stud projecting rearwardly therefrom to contact said button so as to permit actuation of said alarm upon insertion of the tool into said channel, said actuator further including a coil spring that is sleeved around said stud for urging said actuator to move frontwardly.

* * * * *